US010407283B2

(12) United States Patent
Mori et al.

(10) Patent No.: US 10,407,283 B2
(45) Date of Patent: Sep. 10, 2019

(54) MOVING DEVICE FOR COUNTERWEIGHT

(71) Applicant: Caterpillar SARL, Geneva (CH)

(72) Inventors: Kenichi Mori, Tokyo (JP); Ryo Iguchi, Tokyo (JP); Hirokazu Hashimoto, Hyogo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/555,599

(22) PCT Filed: Mar. 2, 2016

(86) PCT No.: PCT/EP2016/054382

§ 371 (c)(1),
(2) Date: Sep. 5, 2017

(87) PCT Pub. No.: WO2016/139226

PCT Pub. Date: Sep. 9, 2016

(65) Prior Publication Data

US 2018/0044150 A1 Feb. 15, 2018

(30) Foreign Application Priority Data

Mar. 2, 2015 (JP) ..... 2015-040226

(51) Int. Cl.
*E02F 9/18* (2006.01)
*B66C 23/74* (2006.01)

(52) U.S. Cl.
CPC ..... *B66C 23/74* (2013.01); *E02F 9/18* (2013.01)

(58) Field of Classification Search
CPC ..... E02F 9/18; B66C 23/74
See application file for complete search history.

(56) References Cited

U.S. PATENT DOCUMENTS 8,434,787 B2 * 5/2013 Halepatali ..... E02F 3/627 212/178
8,702,061 B2 * 4/2014 Suzuki ..... E02F 9/18 212/270

FOREIGN PATENT DOCUMENTS

JP 60110184 U * 7/1985
JP 04-173483 A 6/1992
(Continued)

OTHER PUBLICATIONS

Machine Translation of JP-60-110184 U, Annotations and Summaries provided by Applicant.
(Continued)

*Primary Examiner* — Gerald McClain

(57) ABSTRACT

An apparatus for moving a counterweight includes an attachment fixed to a frame of a machine, a supporting member that includes a supporting face for placing a counterweight thereon when the counterweight is mounted on the machine, and a link mechanism that moves the counterweight. The link mechanism includes an arm and a rotating cylinder that rotates the arm. One end of the arm is pivotally supported by the attachment while the other end of the arm is pivotally supported by the upper inner portion of a recess of the counterweight. One end of the rotating cylinder is pivotally supported by the upper inner portion of the recess of the counterweight. The supporting face is shaped so as to coincide with the arc locus drawn by a contact face arranged on the side of the counterweight, as the counterweight moves. The contact face comes into contact with the supporting face when the counterweight is mounted on the machine. The apparatus has a simple structure that avoids interference between the counterweight and supporting member when the counterweight is moved.

9 Claims, 6 Drawing Sheets

(56) References Cited

FOREIGN PATENT DOCUMENTS

| | | | | | |
|---|---|---|---|---|---|
| JP | 08-333776 | A | | 12/1996 | |
| JP | 08319637 | A | * | 12/1996 | ..... E02F 9/18 |
| JP | 2007162454 | A | * | 6/2007 | ..... E02F 9/18 |
| JP | 2008-255611 | A | | 10/2008 | |
| JP | 2012-057299 | A | | 3/2012 | |
| JP | 2013011144 | A | * | 1/2013 | ..... E02F 9/18 |
| JP | 2013133666 | A | * | 7/2013 | ..... E02F 9/18 |

OTHER PUBLICATIONS

Machine Translation of JPH0831737, Annotations provided by Applicant.

* cited by examiner

MOVING DEVICE FOR COUNTERWEIGHT

CROSS-REFERENCE TO RELATED APPLICATIONS

This application is a national phase application of International Patent Application No. PCT/EP2016/054382 filed Mar. 2, 2016, which claims priority to Japanese Patent Application No. 2015-040226 filed Mar. 2, 2015, both of which are incorporated by reference herein in their entireties for all purposes.

TECHNICAL FIELD

The present invention relates to a moving device for a counterweight mounted on a construction machine such as a hydraulic shovel or a crane truck.

BACKGROUND ART

A counterweight is mounted on a construction machine such as a hydraulic shovel or a crane truck for the purpose of fall prevention and vibration suppression of a machine body during work, improvement of static stability during a heavy load, and the like. The counterweight is attached to and detached from the machine body, for example, during transportation of the construction machine and during replacement of a work device mounted on the machine body. In order to facilitate the attachment and detachment of the counterweight, a moving device that moves (lifts and lowers) the counterweight between the ground and the height (a mounting position) of the machine body is sometimes provided in the construction machine.

As the moving device for the counterweight, a moving device including a lifting and lowering mechanism (a link mechanism) including an arm member and a cylinder for lifting and lowering has been known. For example, a device of Patent Literature 1 includes a turning arm (an arm member), one end of which is pin-coupled to the rear end side of a revolving frame (a machine body frame), and a cylinder for lifting and lowering that turns the turning arm in the vertical direction. The device extends and retracts the cylinder for lifting and lowering to thereby turn the turning arm and move a counterweight, which is suspended at the other end of the turning arm, in an arc shape.

Incidentally, the counterweight configured to be detachably attachable is mounted (fixed) on a machine body by fastening a bolt to an attachment surface (e.g., an abutting plate of Patent Literature 1), which extends in the vertical direction at the rear end portion of the machine body frame, in the horizontal direction from the back toward the front of the machine body. At this point, when the counterweight is supported by only the bolt extending in the horizontal direction, the total load of the counterweight acts on the bolt in the shearing direction. Therefore, there is a concern about strength. As measures against this concern, there has been proposed a configuration in which a part for supporting, from the downward direction, the counterweight mounted on the machine body frame is provided on the machine body frame side and the load of the counterweight is supported by a portion other than the bolt as well (see, for example, Patent Literatures 2 and 3).

CITATION LIST

Patent Literature

[PTL 1] Japanese Patent Application Laid-Open No. H07-268908

[PTL 2] Japanese Patent Application Laid-Open No. H08-319637

[PTL 3] Japanese Patent Application Laid-Open No. 2012-057299

SUMMARY OF INVENTION

Technical Problem

In the case of a moving device including a supporting section that supports a counterweight from the downward direction as in Patent Literatures 2 and 3 described above, a component for avoiding interference of the counterweight and the supporting section during attachment and detachment of the counterweight is necessary. For example, in Patent Literature 2, a third pin serving as a position for suspending the counterweight is disposed to be located further in the machine body forward direction than a first pin and a second pin respectively at turning centers of a hydraulic cylinder and a link (an arm member) to avoid interference with a vehicle body frame (the supporting section). In Patent Literature 3, in addition to the lifting and lowering mechanism explained above, a lifting and lowering cylinder that lifts the counterweight with respect to a turning-type support member (arm member) is provided. That is, in a device of Patent Literature 3, two cylinders, that is, the cylinder for turning the arm member and the lifting and lowering cylinder for lifting the counterweight are used to avoid interference with a saddle support (the supporting section) counterweight.

However, in the device of Patent Literature 2, the turning centers of the hydraulic cylinder and the link need to be disposed further in machine body backward direction-than the suspending position of the counterweight. Therefore, it is necessary to secure a wide space in the counterweight. A wide space is also necessary on the vehicle body frame. In the device of Patent Literature 3, since the two hydraulic cylinders are used, the number of components increases to cause an increase in costs and the structure of the device is complicated.

The present invention has been devised in view of such problems, relates to a moving device for a counterweight, and has an object of placing the counterweight on a supporting surface in a mounted state on a machine body frame and moving the counterweight while avoiding interference of the counterweight and the supporting surface with a simple configuration. Note that the present invention is not limited to this object. It can be valued as another object of the present invention to achieve action and effects derived by configurations described in forms for carrying out the invention explained below, that is, action and effects not obtained by the related art.

Solution to Problem (1) A moving device for a counterweight, this moving device moving the counterweight between a mounting position of a machine body frame and the ground, the moving device including: an attachment member fixed to the machine body frame; a supporting member fixed to the machine body frame and including a supporting surface on which the counterweight is placed in a mounted state of the counterweight; and a link mechanism attached to the attachment member and configured to move the counterweight.

The link mechanism includes an arm member, one end of which is axially supported by the attachment member and the other end of which is axially supported in an upward direction in a recessed place on the front surface of the counterweight. The link mechanism includes a turning cylinder, one end of which is axially supported by the attachment member and the other end of which is axially supported in an upward direction in the recessed place. The turning cylinder is provided to be extendable and retractable and turns the arm member about the one end of the arm member. Further, a contact surface on a side of the counterweight in contact with the supporting surfaces in the mounted state is formed in a shape based on an arcuate track drawn during the movement of the counterweight.

(2) It is preferable that the contact surface is formed in a shape same as the shape of the supporting surface and is in surface contact with the supporting surface in the mounted state.

(3) It is preferable that the supporting surface is an inclined surface obtained by linearly approximating the track.

(4) Alternatively, it is preferable that the supporting surface is a curved surface extending along the track.

(5) It is preferable that the supporting surface has a shape based on a track at a time when an edge portion on the contact surface on a side opposite a moving direction of the counterweight moves between a position in the mounted state and a position where the edge portion overlaps, in a vertical direction, an edge portion on the supporting surface on a side of the moving direction.

(6) It is preferable that the supporting member is configured to be detachable from the machine body frame.

(7) It is preferable that the moving device includes an adjusting mechanism for adjusting upper and lower positions of the counterweight during mounting of the counterweight. That is, the adjusting mechanism adjusts a mounting position of the counterweight in the vertical direction.

(8) It is preferable that the link mechanism is disposed substantially at the center in the left-right direction of the machine body frame. In this case, it is preferable that a pair of supporting members are respectively disposed on both left and right sides of the link mechanism. Note that "substantially the center in the left-right direction" does not have to be strictly a left-right direction center position and means that a certain degree of an error is allowed. That is, the link mechanism may be disposed in a position slightly offset in the left or right direction from the left-right direction center position of the machine body frame.

Advantageous Effects of Invention

In the disclosed moving device for the counterweight, the supporting surface supporting the counterweight from the downward direction is formed in the shape based on the arcuate track drawn by the contact surface. Consequently, with the link mechanism having a simple configuration of providing one turning cylinder that turns the arm member, it is possible to move (lift and lower) the counterweight while avoiding interference of the contact surface of the counterweight and the supporting surface on the machine body frame side. Note that it is possible to reduce manufacturing costs and product costs by simplifying the configuration.

In the disclosed moving device for the counterweight, the counterweight is placed on the supporting surface in the mounted state of the counterweight. Therefore, it is possible to support the load of the counterweight with the supporting surface as well. It is possible to reduce a load acting on bolts for fixing the counterweight.

DESCRIPTION OF EMBODIMENTS

A moving device for a counterweight according to an embodiment is explained with reference to the drawings. The embodiment explained below is only an illustration and is not meant to exclude various modifications and applications of techniques not clearly indicated by the embodiment explained below. Configurations of this embodiment can be variously modified and implemented in a range not departing from the gist of the configurations and can be selected according to necessity or can be combined as appropriate.

[1. Configuration]

Figure 1:
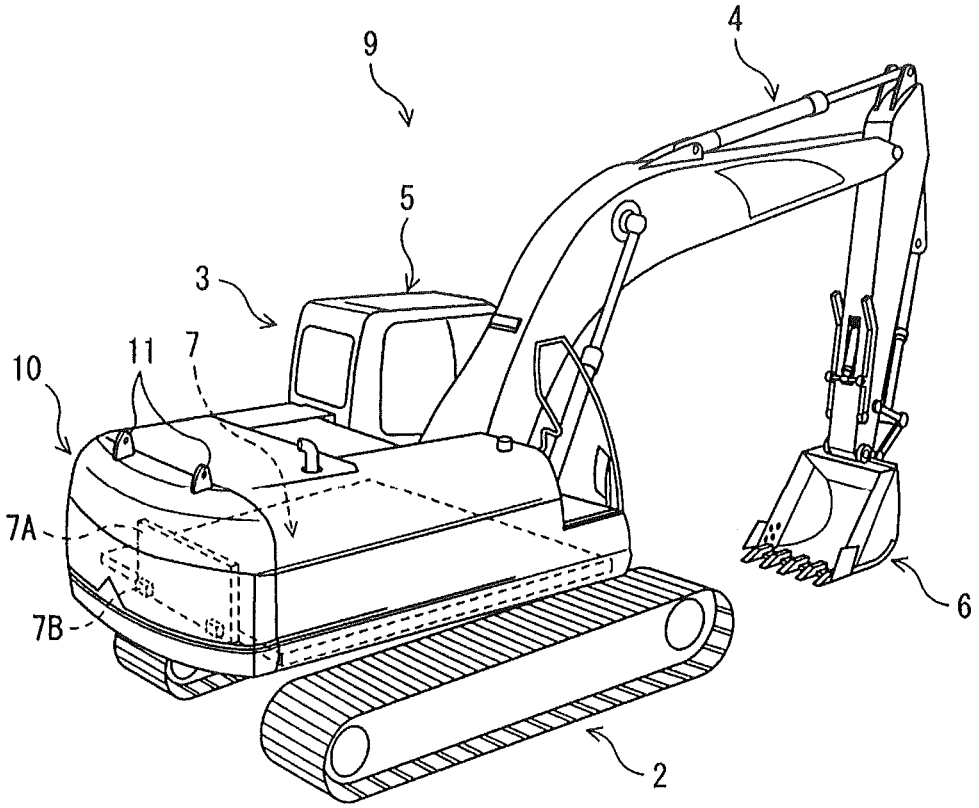
FIG. 1 is a perspective view showing a construction machine applied with a moving device for a counterweight according to an embodiment.

In FIG. 1, a construction machine (a work machine) mounted with a moving device for a counterweight of this embodiment is shown. In this embodiment, a hydraulic shovel 9 functioning as the construction machine is illustrated. In the following explanation, a traveling direction of the hydraulic shovel 9 is set as a forward direction and the opposite direction is set as a backward direction. The left and the right are set on the basis of the forward direction. The direction of the gravity is set as a downward direction and the opposite direction is set as an upward direction. In explanation of devices and components mounted on a machine body, a vertical direction, a left-right direction, and a front-back direction are set on the basis of a state in which the devices and the components are mounted on the machine body.

The hydraulic shovel 9 includes a crawler-type lower traveling body 2 and an upper revolving body 3 provided to be capable of revolving in the upward direction of the lower traveling body 2. In the upper revolving body 3, a work device 4, which performs various kinds of work, and a cab 5, which is a driver's operation room, are mounted in a front part of the upper revolving body 3. Power units such as an engine and a hydraulic pump, a fuel tank, a hydraulic oil tank, and the like (all of which are not shown in the figure) are mounted in a rear part of the upper revolving body 3. Further, a counterweight 10 is mounted in the rearmost part of the upper revolving body 3. Note that, in the work device 4, various attachments 6 such as a bucket and a hydraulic breaker are mounted on the frontmost part of the work device 4.

The upper revolving body 3 includes a machine body frame 7 that forms the lower surface of the upper revolving body 3. The machine body frame 7 is a framework member of the hydraulic shovel 9 and configured by a bottom plate, a side plate, a reinforced plate, and the like having high strength. The work device 4, the cab 5, the power units, and the like are mounted in a predetermined position on the machine body frame 7. The machine body frame 7 includes a fixed section 7A extending in the left-right direction and the vertical direction substantially in the center in the left-right direction of the rear end portion of the machine body frame 7 and two protrusion sections 7B protruded toward a machine body backward direction in a lower part of the rear surface of the fixed section 7A. The fixed section 7A is a part to which the counterweight 10 is fixed. The fixed section 7A is disposed such that the lower edge portion of the fixed section 7A does not project further in the downward direction than the lower surface of the machine body frame 7. The protrusion sections 7B are parts functioning as supporting sections that support the counterweight 10 from the downward direction. The two protrusion sections 7B are spaced apart from each other in the left-right direction and disposed to be symmetrical with respect to a left-right direction center line.

The counterweight 10 is a heavy load that keeps weight balance of the machine body during work. The counterweight 10 can be attached to and detached from the hydraulic shovel 9 of this embodiment. That is, in the hydraulic shovel 9, the counterweight 10 placed on a ground G can be lifted and mounted on the machine body frame 7. The counterweight 10 mounted on the machine body frame 7 can be detached and lowered to the ground G. In the hydraulic shovel 9, a moving device 1 is provided that moves (lifts and lowers) the counterweight 10 in the vertical direction when the counterweight 10 is mounted and detached.

Note that the counterweight 10 includes, on the upper surface thereof, two locking sections 11 protruded toward the upward direction. The two locking sections 11 are spaced apart from each other in the left-right direction in a state in which the counterweight 10 is mounted on the machine body frame 7 and are disposed to be symmetrical with respect to the left-right direction center line. The locking sections 11 are parts formed in a flat shape. In the locking sections 11, hole sections for catching hooks are drilled in the centers thereof. The hooks are locked to the locking sections 11 when the counterweight 10 is hoisted from the ground G by a not-shown hoisting apparatus (a crane).

In the following explanation, the configuration of the counterweight 10 attached to and detached from the machine body frame 7 is explained in detail and the configuration of the moving device 1 is explained in detail with reference to FIGS. 2 to 5.

Figure 2:
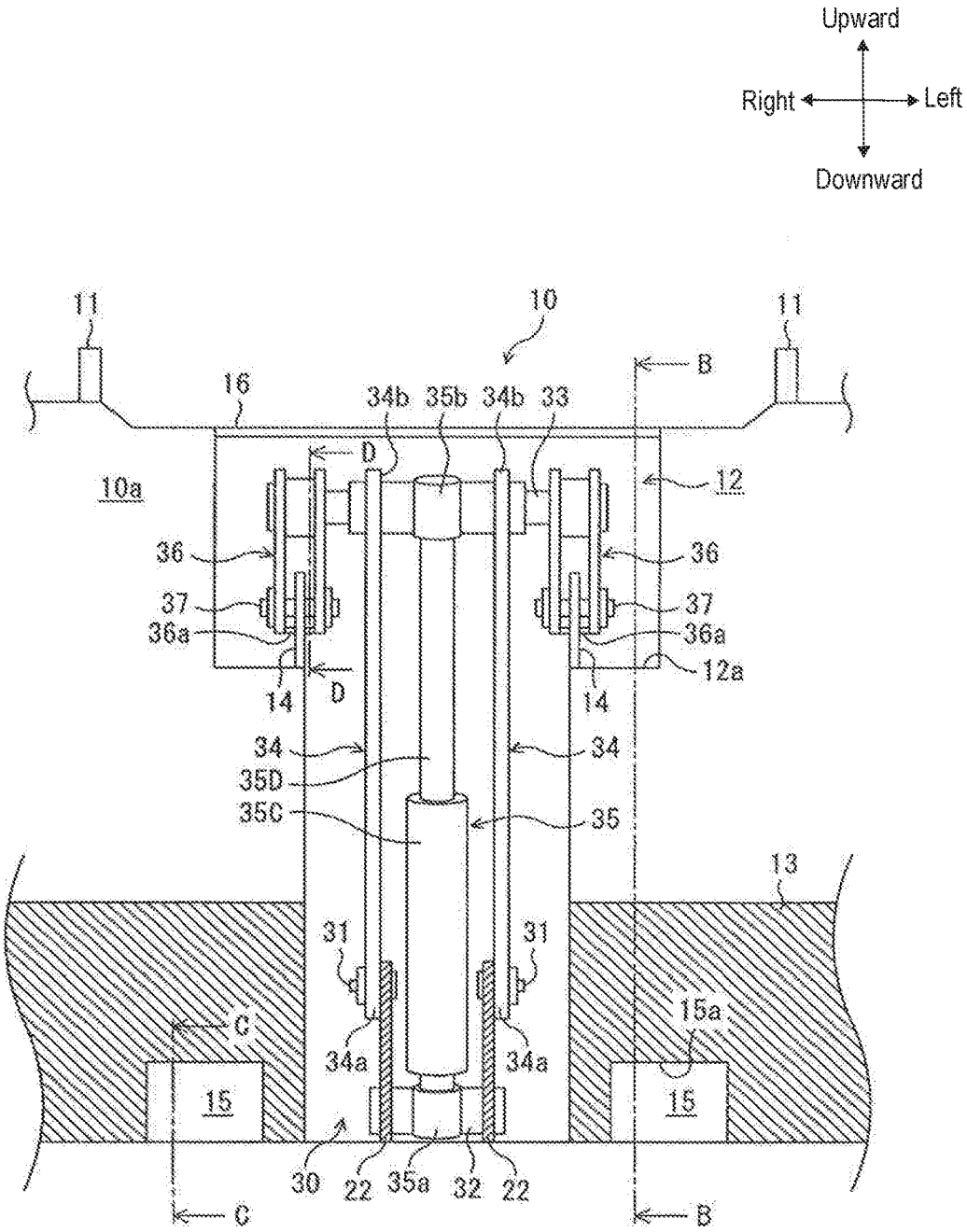
FIG. 2 is a sectional view (an A-A arrow sectional view of FIG. 3) for explaining a link mechanism of the moving device according to the embodiment.
Figure 3:
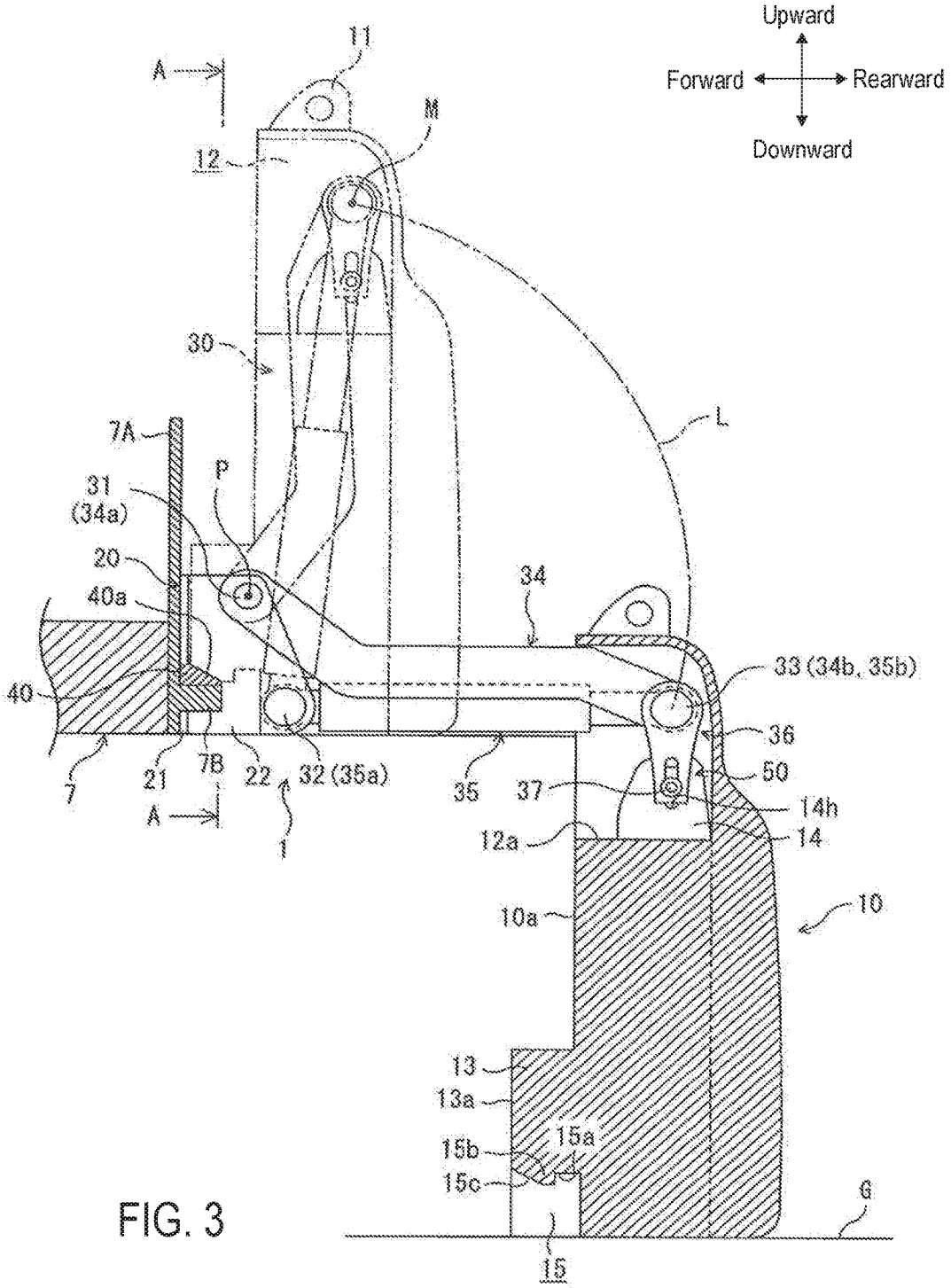
FIG. 3 is a longitudinal sectional view (a B-B arrow sectional view of FIG. 2) for explaining a track during movement of the counterweight by the moving device according to the embodiment.

FIG. 2 is a sectional view (an A-A arrow sectional view of FIG. 3) of a weight front surface 10*a* of the counterweight 10 viewed from the machine body forward direction. Note that the weight front surface 10*a* is a surface facing the machine body forward direction in a mounted state of the counterweight 10. FIG. 3 is a longitudinal sectional view (a B-B arrow sectional view of FIG. 2) of a machine body rear part of the hydraulic shovel 9. In FIG. 3, a state in which the counterweight 10 is lowered to the ground G is indicated by a solid line. The mounted state of the counterweight 10 is indicated by an alternate long and two short dashes line.

As shown in FIG. 2 and FIG. 3, the counterweight 10 of this embodiment includes a recessed place 12 recessed over the vertical direction substantially in the center in the left-right direction of the weight front surface 10*a* and a step section 13 protruded over the left-right direction in a lower part of the weight front surface 10*a*. The recessed place 12 is a space in which a link mechanism 30 explained below of the moving device 1 is housed. The recessed place 12 is opened toward the machine body forward direction. Note that the upward direction of the recessed place 12 is closed by a flat section 16 provided to be detachable by a not-shown bolt. However, the downward direction of the recessed place 12 is opened.

The recessed place 12 includes a step surface 12*a* extending in the horizontal direction in a vertical direction intermediate part. The recessed place 12 is formed such that a left-right direction length in the upward direction of the step surface 12*a* is larger than a left-right direction length in the downward direction of the step surface 12*a*. The recessed place 12 is formed in a T-shape in front view. In the step surface 12*a*, flat suspending plates 14 respectively erected along two corners on the left-right direction center side of the step surface 12*a* are formed. In upper parts of the suspending plates 14, hole sections 14*h*, through which pins 37 explained below are inserted and in which adjusting blocks 51 explained below are disposed, are drilled.

The step section 13 is a part projecting toward the machine body forward direction from the weight front surface 10*a* and is formed in a rectangular shape in side view. On the front surface 13*a* of the step section 13 (in a lower part of the weight front surface 10*a*), two hollow sections 15 opened toward the machine body forward direction and the downward direction are spaced apart from each other in the left-right direction and formed to be symmetrical with respect to the left-right direction center line. The hollow sections 15 are spaces in which the protrusion sections 7B provided in the machine body frame 7 are housed. In the mounted state of the counterweight 10, upper surfaces 15*a* of the hollow sections 15 and a member on the machine body frame 7 side are in contact with each other. The hollow sections 15 of this embodiment include projecting sections 15*b* protruded toward the downward direction in front parts of the upper surfaces 15*a*. Lower surfaces of the projecting sections 15*b* (the front parts of the upper surfaces 15*a*) are in contact with the member on the machine body frame 7 side (in this embodiment, supporting surfaces 40*a* of supporting blocks 40 explained below). In the following explanation, surfaces in contact with the machine body frame 7 side in the upper surfaces 15*a* of the hollow sections 15 are referred to as contact surfaces 15*c*.

The moving device 1 includes an attachment member 20 fixed to the fixed section 7A of the machine body frame 7, the link mechanism 30 for moving the counterweight 10, the supporting blocks 40 (supporting members) fixed to the protrusion section 7B of the machine body frame 7, and an adjusting mechanism 50 for adjusting a position (a mounting position) during mounting of the counterweight 10 in the vertical direction. The attachment member 20 and the link mechanism 30 are disposed substantially in the center of the left-right direction of the machine body frame 7. The supporting blocks 40 are respectively disposed on both the left and right sides of the attachment member 20 and the link mechanism 30. Note that "substantially the center in the left-right direction" does not have to be strictly a left-right direction center position and means that a certain degree of an error is allowed. That is, the attachment member 20 and the link mechanism 30 may be disposed in positions slightly offset in the left or right direction from the left-right direction center position of the machine body frame 7.

As shown in FIG. 2 and FIG. 3, the attachment member 20 includes a substrate 21 disposed along the rear surface of the fixed section 7A and a pair of bearing brackets 22 erected in the perpendicular direction with respect to the substrate 21. In the attachment member 20, the substrate 21 is bolt-fastened to substantially the center in the left-right direction of the fixed section 7A, whereby the bearing bracket 22 is extended toward the machine body backward direction from the substrate 21. Shaft holes are drilled respectively in upper parts and lower parts of the pair of bearing brackets 22. The shaft holes in the upper parts are disposed further in the machine body forward direction than the shaft holes in the lower parts. A first base shaft 31 explained below is inserted through the shaft holes in the upper parts. A second base shaft 32 explained below is inserted through the shaft holes in the lower parts.

The link mechanism 30 includes a pair of arm members 34 and one turning cylinder 35 that turn the counterweight 10, the first base shaft 31 and the second base shaft 32 serving as turning centers of the arm member 34 and the turning cylinder 35, and a support shaft 33 serving as a suspending position when the counterweight 10 is hoisted.

The arm member 34 is a flat thin plate member having a longitudinal direction. The pair of arm members 34 is spaced apart from each other in the left-right direction in a posture in which a normal direction is the left-right direction and is disposed to be symmetrical with respect to the left-right direction center line.

One end 34*a* in the longitudinal direction of the arm member 34 is axially supported by the attachment member 20. The other end 34*b* in the longitudinal direction of the arm member 34 is axially supported in an upward direction in the recessed place 12 of the counterweight 10. The other end 34*b* side turns about the one end 34*a*. In the following explanation, the one end 34*a* of the arm member 34 is referred to as arm proximal end 34*a* and the other end 34*b* is referred to as arm distal end 34*b*. A hole section, through which the first base shaft 31 is inserted, is drilled at the arm proximal end 34*a*. A hole section, through which the support shaft 33 is inserted, is drilled at the arm distal end 34*b*. The arm member 34 is turnably supported by the first base shaft 31 and the support shaft 33 respectively inserted through the hole sections drilled at both the ends.

Specifically, the arm proximal ends 34*a* of the pair of arm members 34 are disposed to overlap, in the left-right direction, the shaft holes drilled in the upper parts of the pair of bearing brackets 22. Two first base shafts 31 are respectively inserted through the hole section of the arm proximal end 34*a* and the shaft hole of the bearing bracket 22, whereby the arm member 34 is provided (pin-joined) turnably with respect to the bearing bracket 22.

On the other hand, one support shaft 33 extending in the left-right direction in the upward direction in the recessed place 12 is inserted through the arm distal ends 34*b* of the pair of arm members 34. Both ends of the support shaft 33 are supported, via a pair of coupling tools 36 and a pair of pins 37, turnably with respect to the suspending plates 14 provided on the step surface 12*a* of the recessed place 12. The support shaft 33 is fixed to an upper part of the coupling tool 36. The pin 37 inserted through the hole section 14*h* of the suspending plate 14 is inserted through and pin-joined to a lower part of the coupling tool 36. Consequently, the arm member 34 is provided turnably with respect to the suspending plate 14. Note that a protrusion 36*a* that regulates movement in the left-right direction of the coupling tool 36 with respect to the suspending plate 14 is provided at the lower end of the coupling tool 36.

The turning cylinder 35 is an actuator for turning the arm member 34. A piston provided at one end of a rod 35D is slidably inserted into and fit in the inside of a tube 35C. The other end of the rod 35D is protruded to the outside of the tube 35C. The turning cylinder 35 is, for example, a hydraulic cylinder actuated by hydraulic pressure fed from a hydraulic pump amounted on the upper revolving body 3. The turning cylinder 35 is provided to be extendable and retractable. The turning cylinder 35 is disposed substantially in the center in the left-right direction of the machine body and located between the pair of arm members 34.

One end 35*a* of the turning cylinder 35 is axially supported by the attachment member 20. The other end 35*b* of the turning cylinder 35 is axially supported in the upward direction in the recessed place 12 of the counterweight 10. The other end 35*b* side turns about the one end 35*a*. In the following explanation, the one end 35*a* of the turning cylinder 35 is referred to as cylinder proximal end 35*a*. The other end 35*b* of the turning cylinder 35 is referred to as cylinder distal end 35*b*. The cylinder proximal end 35*a* is an end portion on a side opposite the rod 35D of the tube 35C. The cylinder distal end 35*b* is the distal end of the rod 35D.

One second base shaft 32 is inserted through the cylinder proximal end 35*a*. Both ends of the second base shaft 32 are respectively inserted through the shaft holes drilled in the lower parts of the pair of bearing brackets 22. Consequently, the turning cylinder 35 is provided (pin-joined) turnably with respect to the bearing bracket 22. On the other hand, the support shaft 33 is inserted through the cylinder distal end 35*b*. That is, the cylinder distal end 35*b* is inserted through substantially the center in the left-right direction of the support shaft 33. The arm distal ends 34*b* are inserted through both sides of the support shaft 33. Further, the coupling tools 36 are fixed to both the sides of the support shaft 33. Consequently, the cylinder other end 35*b* of the turning cylinder 35 is provided turnably with respect to the suspending plate 14.

As shown in FIG. 3, the counterweight 10 moves between the ground G and the mounting position of the machine body frame 7 by the link mechanism 30 configured as explained above. Specifically, as indicated by a solid line in the figure, the pair of coupling tools 36 is respectively joined to, by the pins 37, the pair of suspending plates 14 of the counterweight 10 placed on the ground G. The turning cylinder 35 is operated and extended to turn the arm member 34 about the arm proximal end 34*a* such that the arm distal end 34*b* moves in the upward direction. Consequently, the counterweight 10 is hoisted. As indicated by an alternate long and two short dashes line in the figure, the counterweight 10 moves to the mounting position where the counterweight 10 is mounted on the machine body frame 7.

Note that, when the counterweight 10 mounted on the machine body frame 7 is detached and lowered to the ground G, operation opposite to the operation in lifting the counterweight 10 is performed. That is, the turning cylinder 35 is operated and retracted to turn the arm member 34 about the arm proximal end 34*a* such that the arm distal end 34*b* moved in the downward direction. A track L drawn by the arm distal end 34*b* during such movement of the counterweight 10 is indicated by an alternate long and short dash line. The track L is formed in an arcuate shape centering on a center line (a point P in the figure) of the first base shaft 31, which supports the arm proximal end 34*a*, and having a distance (a straight line) from the center line (the point P) to a center line (a point M in the figure) of the support shaft 33 as a radius. The counterweight 10 moves along the track L.

Figure 4A:
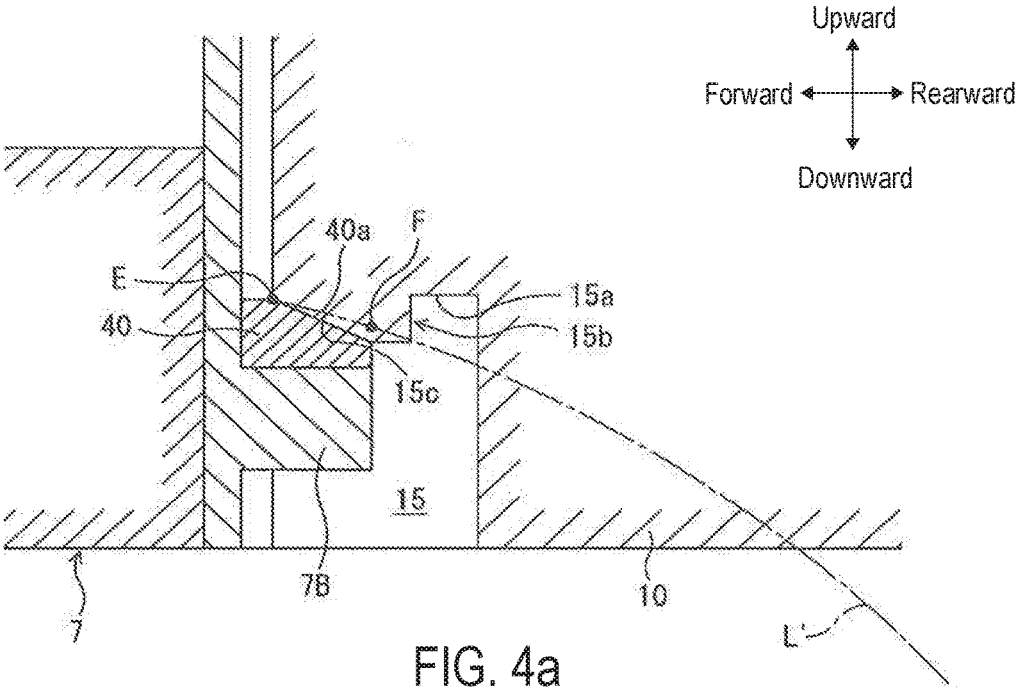
FIGS. 4*a-c* are diagrams for explaining a supporting surface of the moving device according to the embodiment, wherein FIG. 4(*a*) is an enlarged sectional view (a C-C arrow section view of FIG. 2), FIG. 4(*b*) is a perspective view of a supporting block, and FIG. 4(*c*) is a side view showing a fixed state of the supporting block.
Figure 4B:
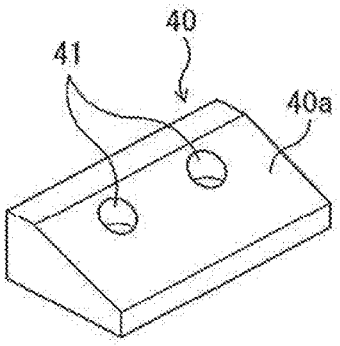
Figure 4C:
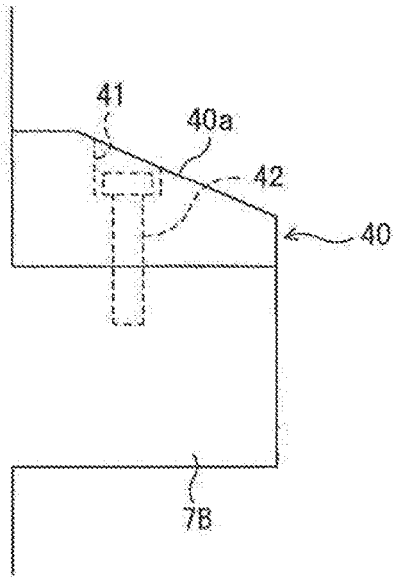

As shown in FIG. 3 and FIGS. 4(*a*) to (*c*), the supporting block 40 is a member that supports the counterweight 10 from the downward direction in the mounted state in which the counterweight 10 is mounted on the machine body frame 7. Note that FIG. 4(*a*) is a longitudinal sectional view (a C-C arrow sectional view of FIG. 2) showing a state in which the counterweight 10 is supported by the protrusion section 7B and the supporting block 40. FIG. 4(*b*) is a perspective view of the supporting block 40. FIG. 4(*c*) is a side view showing a fixed state of the supporting block 40.

The supporting block 40 is formed in a shape obtained by obliquely cutting off one corner extending in the longitudinal direction of a rectangular parallelepiped block. The supporting block 40 is fixed to the machine body frame 7 in a posture in which a flat inclined surface formed by the cutoff faces the upward direction and the backward direction (the normal of the inclined surface extends obliquely the rear upward direction). That is, the inclined surface inclines further in the downward direction toward the machine body backward direction. The inclined surface is a surface that is in contact with the counterweight 10 and supports the counterweight 10 from the downward direction. In the following explanation, the inclined surface is referred to as supporting surface 40*a*. The supporting surface 40*a* is in contact with the contact surface 15*c* provided on the lower surface of the projecting section 15*b* of the counterweight 10.

In FIG. 4(*a*), a track drawn by the front edge portion of the contact surface 15*c* during the movement of the counterweight 10 is indicated by an alternate long and short dash line L'. The track L' coincides with a track obtained by translating the track L drawn by the arm distal end 34*b* such that the point M overlaps a position (a point E) where the front edge portion of the contact surface 15*c* and the supporting block 40 are in contact with each other in the mounted state of the counterweight 10. That is, the track L' is the same arc having a radius same as the radius of the track L shown in FIG. 3.

The supporting surface 40*a* of the supporting block 40 is formed in a shape based on the arcuate track L' drawn by the front edge portion of the contact surface 15*c*. That is, the supporting surface 40*a* is formed in a shape close to the shape of the track L' and not interfering with the track L'. The supporting surface 40*a* of this embodiment is provided as a flat inclined surface obtained by linearly approximating the track L'. As a method of linearly approximating the track L', for example, as shown in FIG. 4(*a*), there is a method of approximating the track L' as a straight line connecting the point E where the supporting block 40 and the front edge portion of the contact surface 15*c* of the counterweight 10 are in contact with each other and a point F where the rear edge portion of the supporting block 40 and the track L' overlap in the vertical direction. The supporting surface 40*a* is provided as an inclined surface at least having a tilt larger than a tilt with respect to the horizontal direction of the straight line connecting the point E and the point F.

The supporting surface 40*a* of this embodiment is formed in a shape based on the track L' at the time when the front edge portion of the contact surface 15*c* moves between the position in the mounted state of the counterweight 10 (i.e., the point E) and the position where the track L' overlap, in the vertical direction, the rear edge portion of the supporting surface 40*a* (the edge portion on the moving direction side of the counterweight 10) (i.e., the point F). That is, the supporting surface 40*a* is formed on the basis of the track L' at the time when, in the track L', an edge portion on the contact surface 15*c* on a side opposite the moving direction of the counterweight 10 moves between the point E and the point F. Since the supporting surface 40*a* is formed in the shape based on the track L' in this way, the contact surface 15*c* and the supporting surface 40*a* do not cross (interfere with) each other during the movement of the counterweight 10. Note that, since the track L and the track L' are the same arc as explained above, the supporting surface 40*a* is also considered to have a shape based on the track L.

The supporting block 40 is placed on the upper surface of the protrusion section 7B and bolt-fastened and fixed to the protrusion section 7B. As shown in FIG. 4(*b*), two cylindrical groove sections 41 recessed to be spaced apart from each other are formed on the supporting surface 40*a*. The cylindrical groove section 41 is formed in a circular shape in top view. As shown in FIG. 4(*c*), the cylindrical groove section 41 is formed at depth for preventing the head of the bolt 42 from projecting to the supporting surface 40*a* and formed such that the bottom surface of the cylindrical groove section 41 extends in the horizontal direction. The bottom surface of the cylindrical groove section 41 functions as a seating surface of the bolt 42. A hole section piercing through in the downward direction is formed in the bottom surface. A tap hole is formed in the protrusion section 7B. The bolt 42 inserted through the hole section of the supporting block 40 is fastened to the tap hole of the protrusion section 7B. Consequently, the supporting block 40 is fixed to the protrusion section 7B.

Note that the supporting block 40 can be detached from the protrusion section 7B by detaching the bolt 42. That is, the supporting block 40 is configured to be detachable from the machine body frame 7.

On the other hand, the contact surface 15*c* of the counterweight 10 is formed in a shape same as the shape of the supporting surface 40*a*. That is, the contact surface 15*c* is provided as a flat inclined surface having a tilt same as the tilt of the supporting surface 40*a*. Consequently, in the mounted state of the counterweight 10, the contact surface 15*c* and the supporting surface 40*a* are in surface contact with each other.

As explained above, when the counterweight 10 is hoisted to the mounting position (the position of the alternate long and two short dashes line in FIG. 3) where the counterweight 10 is mounted on the machine body frame 7, the upper surface 15*a* of the hollow section 15 is located in the upward direction of the protrusion section 7B of the machine body frame 7. The contact surface 15*c* of the hollow section 15 is in surface contact with the supporting surface 40*a* of the supporting block 40 fixed to the protrusion section 7B. The counterweight 10 is supported by the supporting block 40 and the protrusion section 7B.

Figure 5:
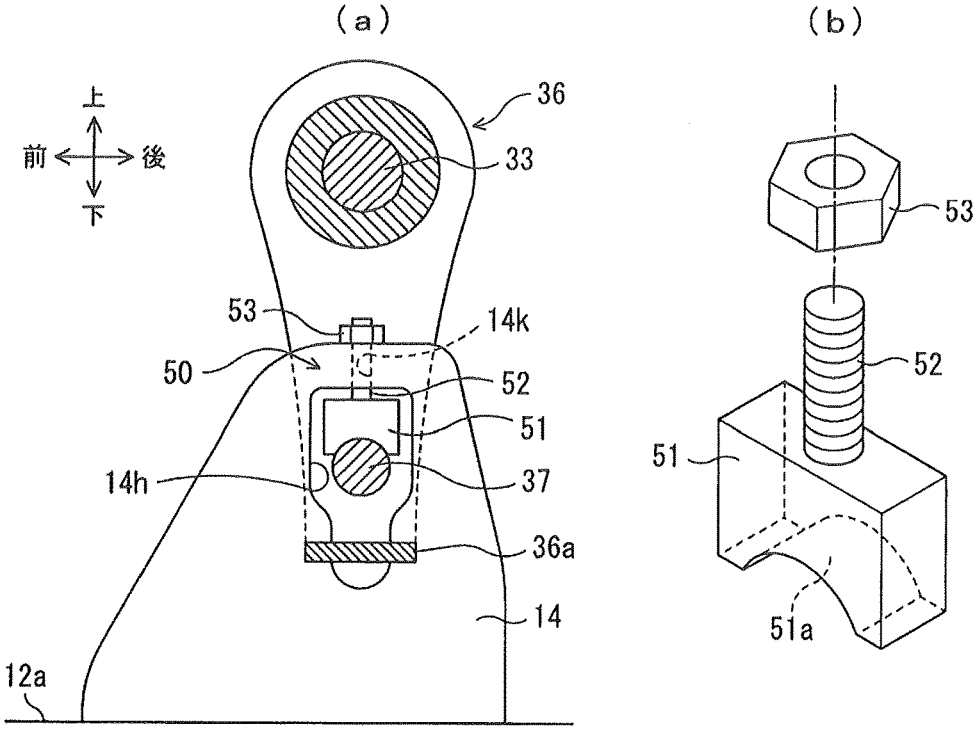
FIG. 5 is a diagram for explaining an adjusting mechanism of the moving device according to the embodiment, wherein (a) is a longitudinal sectional view (a D-D arrow sectional view of FIG. 2) of the adjusting mechanism and the periphery thereof and (b) is a perspective view showing an adjusting block and a nut.

Depending on a backlash, a dimension tolerance, or the like of the link mechanism 30, delicate position adjustment in the vertical direction is sometimes necessary in the mounted state of the counterweight 10. Therefore, the moving device 1 of this embodiment includes the adjusting mechanism 50 for adjusting upper and lower positions during the mounting of the counterweight 10. As shown in FIGS. 5(*a*) and (*b*), the adjusting mechanism 50 of this embodiment includes a tap hole 14*k* formed in the suspending plate 14, an adjusting block 51 in which a screw section 52 is integrally provided, and a nut 53 that screws with the screw section 52. Note that FIG. 5(*a*) is a longitudinal sectional view (a D-D arrow sectional view of FIG. 2) for explaining the adjusting mechanism 50. FIG. 5(*b*) is a perspective view showing the configuration of the adjusting mechanism 50.

As explained above, the suspending plate 14 includes the hole section 14*h* drilled in the upper part. In side view, the hole section 14*h* is formed in a shape obtained by combining a long hole below a rectangular hole. The tap hole 14*k* is a hole section in which a screw groove formed to pierce through from the upper surface of the suspending plate 14 to the hole section 14*h* is cut. The adjusting block 51 includes, on the lower surface of a rectangular parallelepiped block, a curved surface section 51*a* recessed in an arcuate shape and includes a perpendicularly erected screw section 52 on a surface (the upper surface) on the side opposite the curved surface section 51*a*.

The adjusting block 51 is disposed in a rectangular portion of the hole section 14*h* of the suspending plate 14. The screw section 52 is screwed in the tap hole 14*k* from the hole section 14*h* side. The nut 53 is screwed with the screw section 52 projecting from the upper surface of the suspending plate 14. A cylindrical surface of the pin 37 is set in contact with the curved surface section 51*a* of the adjusting block 51. Therefore, the upper and lower positions of the pin 37 are adjusted by rotating the adjusting block 51 and adjusting a screwing length of the screw section 52 with respect to the tap hole 14*k* of the suspending plate 14. The pin 37 is inserted through the lower part of the coupling tool 36. Therefore, when the upper and lower positions of the pin 37 are adjusted, the upper and lower positions of the coupling tool 36, that is, the upper and lower positions of the support shaft 33 are adjusted. Consequently, since a suspending position of the counterweight 10 is adjusted in the vertical direction, the contact surface 15*c* and the supporting surface 40*a* are surely set in surface contact with each other.

Note that the counterweight 10 is mounted (fixed) on the machine body frame 7 when, in a state in which the counterweight 10 is hoisted to the mounting position, a plurality of bolts (not shown in the figure) are inserted through toward the machine body forward direction from the rear surface of the counterweight 10 and the bolts are fastened to the fixed section 7A. When the counterweight 10 is lowered to the ground G, after the bolts are detached, the operation explained above is performed.

[2. Action and Effects]

In the moving device 1 explained above, the supporting surface 40*a* that supports the counterweight 10 from the downward direction is formed in the shape based on the arcuate track L' drawn by the front edge portion of the contact surface 15*c*. Consequently, with the link mechanism 30 having the simple configuration of providing one turning cylinder 35 that turns the arm member 34, it is possible to move the counterweight 10 while avoiding interference of the contact surface 15*c* of the counterweight 10 and the supporting surface 40*a* on the machine body frame 7 side. Note that it is possible to reduce manufacturing costs and the product costs by simplifying the configuration.

In the moving device 1 explained above, the counterweight 10 is placed on the supporting surface 40*a* in the mounted state of the counterweight 10. Therefore, the load of the counterweight 10 can be supported by the supporting surface 40*a* as well. It is possible to reduce a load acting on the bolts for fixing the counterweight 10.

Note that, in the moving device 1 explained above, the shape of the supporting surface 40*a*, which supports the counterweight 10, is devised to avoid interference of the counterweight 10 and the supporting surface 40*a*. Therefore, for example, unlike Patent Literature 2 described above, it is unnecessary to dispose the centers of the first base shaft 31 and the second base shaft 32 to be located further in the machine body backward direction than the center of the support shaft 33 and avoid interference during the movement of the counterweight 10. Therefore, with the moving device 1 explained above, it is unnecessary to increase the size of the recessed place 12 of the counterweight 10. It is unnecessary to provide, in the rear end portion of the machine body frame 7, a wide space for avoiding the interference during the movement. That is, with the moving device 1 explained above, it is possible to achieve space saving. It is possible to increase a degree of freedom of a layout of the upper revolving body 3.

In the moving device 1 explained above, the contact surface 15*c* provided in the counterweight 10 is formed in the shape same as the shape of the supporting surface 40*a*. The contact surface 15*c* is in surface contact with the supporting surface 40*a* in the mounted state of the counterweight 10. Consequently, the load of the counterweight 10 does not concentratedly act on a part of the supporting surface 40*a*. It is possible to stably support the counterweight 10 with the supporting surface 40*a*.

In the moving device 1 explained above, the supporting surface 40*a* is provided as the inclined surface obtained by linearly approximating the track L'. Therefore, it is possible to simplify the configuration of the moving device 1. It is possible to easily perform machining of the supporting surface 40*a* as well.

The supporting surface 40*a* of this embodiment is formed in the shape based on the track L' at the time when the front edge portion of the contact surface 15*c* moves between the position in the mounted state of the counterweight 10 (i.e., the point E) and the position where the front edge portion overlaps the rear edge portion of the supporting surface 40*a* in the vertical direction (i.e., the point F). Consequently, it is possible to further avoid the interference of the contact surface 15*c* and the supporting surface 40*a* during the movement of the counterweight 10. Since the inclination angle of the supporting surface 40*a* with respect to the horizontal direction decreases, it is possible to more stably support the counterweight 10.

In the moving device 1 explained above, the supporting block 40 including the supporting surface 40*a* is provided detachably attachable to the protrusion section 7B of the machine body frame 7. Consequently, irrespective of the mounted state of the moving device 1, it is possible to make the configuration of the machine body frame 7 common. That is, it is possible to apply the moving device 1 of this embodiment to the existing machine body frame 7 as well.

The moving device 1 explained above includes the adjusting mechanism 50 for adjusting the upper and lower positions during the mounting of the counterweight 10. Therefore, even if there is a backlash, a dimension error, or the like of the link mechanism 30, it is possible to firmly set the counterweight 10 in contact with the supporting surface 40*a*. It is possible to surely support the counterweight 10 with the supporting surface 40*a*.

In the moving device 1 explained above, the link mechanism 30 is disposed substantially in the center in the left-right direction of the machine body frame 7. The supporting blocks 40 are respectively disposed on both the left and right sides of the link mechanism 30. Consequently, it is possible to move the counterweight 10 in good balance. It is possible to stably support the counterweight 10.

[3. Others]

The embodiment of the present invention is explained above. However, the present invention is not limited to the embodiment explained above and can be variously modified in a range not departing from the spirit of the present invention.

Figure 6:
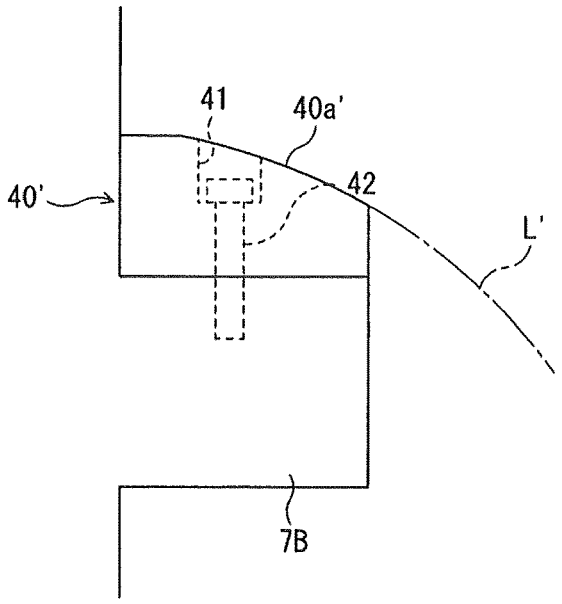
FIG. 6 is a side view showing a fixed state of a supporting block according to a modification.

The configuration of the supporting surface 40*a* explained above is an example and is not limited to the configuration explained above. For example, as shown in FIG. 6, a supporting surface 40*a*' may be a curved surface extending along the track L'. With such a configuration, it is possible to more surely support the counterweight 10 while avoiding interference of the contact surface 15*c* and the supporting surface 40*a*' during the movement of the counterweight 10. Note that the supporting surface 40*a* may be provided integrally with the machine body frame 7. That is, the supporting block 40 may be provided, for example, using the upper surface of the protrusion section 7B as a supporting surface rather than being provided as a separate body. In this case, the protrusion section 7B functions as a supporting member.

The shape of the counterweight 10 is not limited to the shape explained above. For example, the counterweight 10 may not have the step section 13. The weight front surface 10*a* may be a surface extending in the vertical direction. The contact surface 15*c* in contact with the supporting surface 40*a* may not be provided as a part of the upper surface 15*a* of the hollow section 15 explained above. For example, when the position of the supporting member is provided to extend along the lower end face of the machine body frame 7, the contact surface may be formed by cutting out the lower end portion of the weight front surface 10*a*. Alternatively, when the supporting member is protruded further in the downward direction than the lower end face of the machine body frame 7, the contact surface may be provided on the lower end face of the counterweight 10. Note that the contact surface 15*c* does not have to be formed in the shape same as the shape of the supporting surface 40*a*. For example, the contact surface and the supporting surface 40*a* may be planes having the same tilt and formed to have different sizes of the planes. When the supporting surface 40' is the curved surface as shown in FIG. 6, the contact surface may be a curved surface having a radius same as the radius of the supporting surface 40' and formed to convex toward the upward direction.

Figure 7:
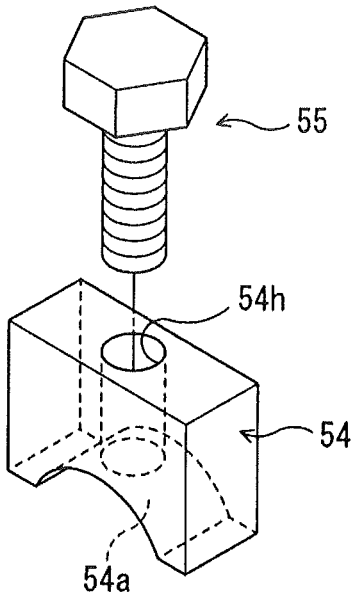
FIG. 7 is a perspective view showing an adjusting block and a bolt according to the modification.

The configuration of the adjusting mechanism 50 explained above is an example and is not limited to the configuration explained above. For example, as shown in FIG. 7, an adjusting mechanism may include an adjusting block 54 in which a tap hole 54*h* is formed in addition to the tap hole 14*k* formed in the suspending plate 14 shown in FIG. 5(*a*) and a bolt 55 that screws in the two tap holes 14*k* and 54*h*. The adjusting block 54 is disposed in a rectangular portion of the hole section 14*h* of the suspending plate 14. On the other hand, the bolt 55 is screwed in the tap holes 14*k* and 54*h* from the upward direction of the suspending plate 14. The cylindrical surface of the pin 37 is set in contact with a curved surface section 54*a* of the adjusting block 54.

In such an adjusting mechanism, the upper and lower positions of the pin 37 are adjusted by rotating the bolt 55 and adjusting a screwing length of the bolt 55 with respect to the tap hole 54*h* of the adjusting block 54. Therefore, even in such an adjusting mechanism, it is possible to obtain effects same as the effects explained above. Note that a position where the adjusting mechanism 50 is provided is not limited to the position explained above. The adjusting mechanism 50 only has to be provided in a position where a positional relation in the vertical direction between the counterweight 10 and the machine body frame 7 or the supporting surface 40*a* at the time when the counterweight 10 is mounted changes (can be adjusted).

In the embodiment explained above, the moving device 1 that moves the counterweight 10 of the hydraulic shovel 9 is illustrated. However, a construction machine applied with the moving device 1 is not limited to the hydraulic shovel 9. The moving device 1 can be applied to various construction machines.

What is claimed is:

1. A moving device for a counterweight, the moving device moving the counterweight between a mounted state on a machine body frame and a ground, the moving device comprising:

an attachment member fixed to the machine body frame;

a supporting member fixed to the machine body frame and including a supporting surface on which the counterweight is placed in the mounted state, the supporting surface having an inclined surface that faces an upward and backward direction relative to the machine body;

a step section defined on the counterweight, the step section projects axially forward relative to a front surface of the counterweight;

a contact surface defined along a lower portion of the step section, the contact surface being complimentary to the supporting surface of the supporting member, and the contact surface and the supporting surface being in contact with each other when the counterweight is in the mounted state; and a link mechanism attached to the attachment member and configured to move the counterweight, wherein the link mechanism includes:

an arm member, a proximal end of which is axially supported by the attachment member and a distal end of which is axially supported in an upper portion of a recessed place on the front surface of the counterweight; and a turning cylinder, one end of which is axially supported by the attachment member and another end of which is axially supported in the upper portion of the recessed place, the turning cylinder being provided to be extendable and retractable and turn the distal end of the arm member about the proximal end of the arm member to move the counterweight along an arcuate track that extends along a single arcuate track entirely between a ground state and the mounted state, and wherein the supporting surface in contact with the contact surface of the step section in the mounted state is formed in a shape based on the arcuate track corresponding to the movement of the contact surface of the step section.

2. The moving device for a counter weight according to claim 1, wherein the arcuate track does not extend through a plane that is perpendicular with the ground.

3. The moving device for a counterweight according to claim 1, wherein the supporting surface is an inclined surface obtained by linearly approximating the arcuate track.

4. The moving device for a counterweight according to claim 1, wherein the supporting surface is a curved surface extending along the arcuate track.

5. The moving device for a counterweight according to claim 1, wherein the supporting surface has a shape based on a track at a time when an edge portion on the contact surface on a side opposite a moving direction of the counterweight moves between a position in the mounted state and a position where the edge portion overlaps, in a vertical direction, an edge portion on the supporting surface on a side of the moving direction.

6. The moving device for a counterweight according to claim 1, wherein the supporting member is a support block configured to be detachable from the machine body frame and to support the counterweight from a downward direction below the contact surface.

7. The moving device for a counterweight according to claim 1, further comprising an adjusting mechanism for adjusting upper and lower positions of the counterweight during mounting of the counterweight.

8. The moving device for a counter weight according to claim 1, wherein the link mechanism is disposed substantially at a center in a left-right direction of the machine body frame, and the supporting member includes a pair of supporting members disposed on the attachment member with one supporting member of the pair of supporting members being positioned on a left side of the link mechanism and the other supporting member of the pair of supporting members being positioned on a right side of the link mechanism.

9. The moving device for a counter weight according to claim 1, wherein the link mechanism includes only one turning cylinder.

* * * * *